US006619934B2

(12) United States Patent
Loprete et al.

(10) Patent No.: US 6,619,934 B2
(45) Date of Patent: Sep. 16, 2003

(54) SCROLL COMPRESSOR WITH MOTOR CONTROL FOR CAPACITY MODULATION

(75) Inventors: Joseph F. Loprete, Bristol, TN (US); John R. Williams, Arkadelphia, AR (US); Gene Michael Fields, Arkadelphia, AR (US); Joe T. Hill, Arkadelphia, AR (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 10/225,827

(22) Filed: Aug. 22, 2002

(65) Prior Publication Data

US 2002/0197172 A1 Dec. 26, 2002

Related U.S. Application Data

(63) Continuation of application No. 09/090,358, filed on Jun. 4, 1998, now abandoned.

(51) Int. Cl.[7] ..... F04B 17/04; F04B 23/00

(52) U.S. Cl. ..... 417/410.5; 417/310; 417/440; 417/299

(58) Field of Search ..... 417/410.5, 310, 417/440, 299

(56) References Cited

U.S. PATENT DOCUMENTS

| | | | | |
|---|---|---|---|---|
| 3,319,494 A | | 5/1967 | Ulbing | |
| 4,137,014 A | | 1/1979 | Parker | |
| 4,137,798 A | * | 2/1979 | Sisk et al. | 475/12 |
| 4,494,447 A | | 1/1985 | Sisk | |
| 4,934,910 A | | 6/1990 | Utter | |
| 5,494,421 A | | 2/1996 | Wada et al. | |
| 5,678,985 A | * | 10/1997 | Matsuura et al. | 297/367 |
| 5,803,716 A | * | 9/1998 | Wallis et al. | 417/310 |

FOREIGN PATENT DOCUMENTS

| | | |
|---|---|---|
| EP | 0052461 A1 | 11/1981 |
| EP | 0126238 A1 | 3/1984 |
| GB | 01593446 | 5/1978 |

OTHER PUBLICATIONS

European Search Report dated Nov. 22, 1999.

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

Several transmission embodiments selectively communicate rotary drive to an orbiting scroll to achieve capacity modulation. In these embodiments, when the motor is driven in a first direction, the orbiting scroll is driven at a rate which is equal to the motor speed. However, if the motor is driven in a reverse direction, the orbit rate of the orbiting scroll is reduced. The transmission ensures that the orbiting scroll member itself is driven in the proper forward direction regardless of whether the motor is being driven in forward or reverse.

18 Claims, 3 Drawing Sheets

SCROLL COMPRESSOR WITH MOTOR CONTROL FOR CAPACITY MODULATION

This application is a continuation of U.S. patent application Ser. No. 09/090,358 filed Jun. 4, 1998, now abandoned.

BACKGROUND OF THE INVENTION

This invention relates to a scroll compressor with a drive providing capacity modulation by reverse rotation of the motor.

Scroll compressors are becoming widely utilized in refrigerant compression applications. Scroll compressors consist of a pair of interfitting wraps which move relative to each other to compress a refrigerant.

While scroll compressors are becoming very popular, there are some design challenges. One design challenge with scroll compressors relates to controlling the output volume, or capacity, of the scroll compressor.

The volume of the compression chambers is relatively static, thus it is not easy to change capacity by changing the volume of the chambers. Nor is it easy to change volume by changing the speed of the motor, as this would require an expensive motor and control.

Most simple electrical motors utilized in scroll compressors are reversible. However, a scroll compressor cannot typically be driven in reverse for any length of time without resulting in some undesirable characteristics.

It would be desirable to achieve capacity control with a simple reversible electrical motor.

SUMMARY OF THE INVENTION

Several embodiments are disclosed wherein a reversible motor rotates in a first direction and drives a shaft and an orbiting scroll to orbit relative to a fixed, or non-orbiting, scroll. This orbiting will be at a first high rate which is roughly equal to the motor speed. Of course, the orbiting scroll orbits while the motor shaft rotates. However, the motor shaft speed revolutions will be approximately equal to the orbiting cycles of the orbiting scroll during forward rotation.

On the other hand, when capacity modulation is desired, the motor is caused to be driven in a reverse direction. An appropriate drive connection between the shaft and the orbiting scroll will no longer drive the orbiting scroll at the first rate. Instead, a reduced speed is achieved when the motor is driven in the reverse direction. A transmission ensures the orbiting scroll is still driven in the forward direction even though the motor is being driven in the reverse direction.

In two embodiments, a system of roller clutches transmits drive directly from the motor to the orbiting scroll shaft when the motor is driven in a forward direction. However, when the motor is driven in a reverse direction, the roller clutches actuate a gear reduction, and in a preferred embodiment, a planetary gear reduction such that the speed of the orbiting scroll is reduced. Preferably, the speed is reduced to approximately 30%–70%, and in one embodiment 50% of the speed in the forward direction.

In one embodiment, the planetary gear system is provided between the shaft and the motor roller. In this embodiment, the counterweights can function as normal.

In a second embodiment, the planetary transmission is disposed between the shaft, and an eccentric for driving the orbiting scroll.

In a third embodiment, a gear reduction is not utilized. Instead, a "ratchet" device is utilized which will only drive the orbiting scroll a portion of the time when the motor is driven in reverse. During the other half, rotation will not drive the crank pin such that it will slip, and not cause rotation of the orbiting scroll.

The disclosed embodiments are somewhat exemplary. The main aspect of this invention relates to the use of a transmission to provide two levels of capacity by reversing the motor drive direction. These and other features of the present invention can be best understood from the following specification and drawings, the following of which is a brief description.

DETAILED DESCRIPTION OF A PREFERRED EMBODIMENT

Figure 1:
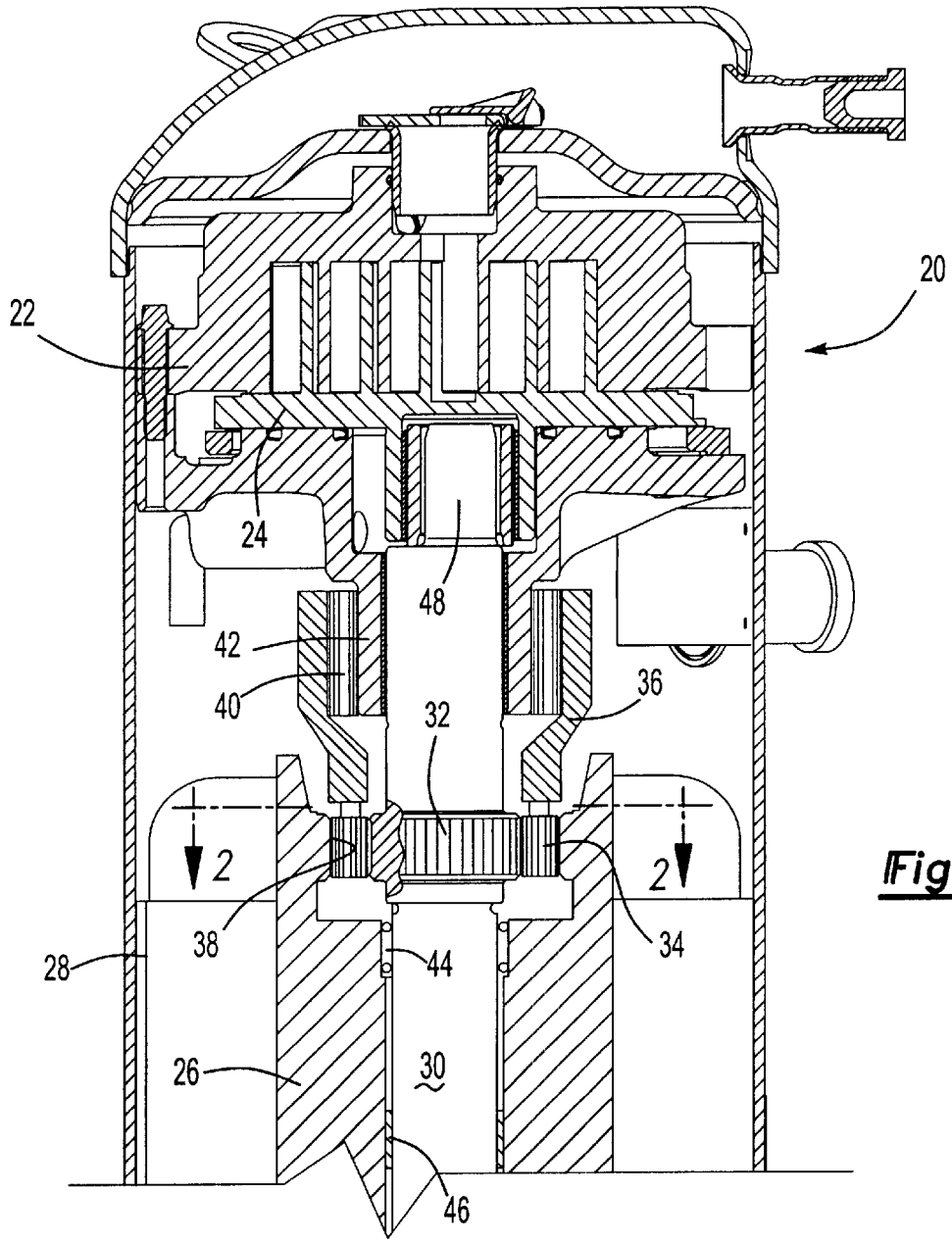
FIG. 1 is a cross-sectional view of a first embodiment scroll compressor.

A scroll compressor 20 is illustrated in FIG. 1 having fixed or non-orbiting scroll wrap 22. An orbiting scroll wrap 24 interfits with scroll wrap 22 to define compression chambers, as known. A motor rotor 26 is associated with a motor stator 28 and serves to selectively drive the motor shaft 30. Motor shaft 30 carries a sun gear 32 of a planetary transmission. Planet gears 34 surround sun gear 32. A planet gear carrier 36 extends away from the planet gears 34. The planet gears 34 engage a ring gear 38, which is formed on an inner surface of the motor rotor 26.

A roller clutch 40 is positioned between the planet gear carrier 36 and a crank case portion 42. A second roller clutch 44 is positioned between the rotor 26 and the shaft 30. Bushings 46 are also positioned between the shaft 30 and the rotor 26.

When motor 26 is driven in the forward direction, the roller clutch 44 operates to drive shaft 30 in the forward direction. At this time, the roller clutch 40 allows the planet gear carrier 36 to free-wheel on the crank case 42. Thus, the rotor 26 rotates, shaft 30 rotates at the same speed as the rotor 26, and the orbiting scroll 24 is driven through the eccentric 48 of the shaft 30.

Figure 2:
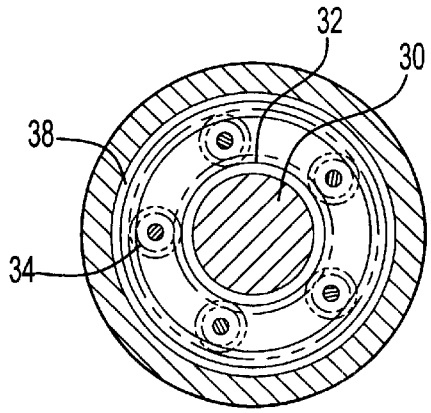
FIG. 2 is a cross-sectional view along line 2—2 of FIG. 1.

FIG. 2 shows the arrangement of the shaft 30, the sun gear 32, the planet gears 34, and the ring gear 38. As shown, there are a plurality of planet gears 34.

When the motor 26 is caused to rotate in reverse, the roller clutch 44 slips and will not drive the shaft 30. Instead, the ring gear 38 rotates the planet gears 34. The planet gears 34 try to rotate the planet gear carrier 36. However, the roller clutch 40 will no longer allow slipping between the planet gear carrier 36 and the fixed crank case 42. This prevents the planet gears 34 from orbiting about shaft 30, and instead causes the sun gear 32 to be driven. The gear reduction between the ring gear 38, the planet gears 34, and the sun gear 32 provides a speed reduction between the speed of the rotor 26 and the speed of the shaft 30.

The roller clutches 40 and 44 are known roller clutches which transmit rotation when driven in one direction, but allow slippage between two parts when they are driven in the opposed direction relative to each other. The two are designed such that they allow rotation in opposed directions relative to each other. Such roller clutches are well known.

An appropriate control can be associated with the motor, and the motor can be driven in a selected direction to achieve capacity modulation when desired. When full capacity is desired, the motor is driven in a forward direction. When a reduced capacity is desired, the motor is driven in the reverse direction. The simple mechanical connection ensures that the compressor will operate regardless of the direction of rotation of the motor, and that the capacity reduction will be achieved as desired.

Figure 3:
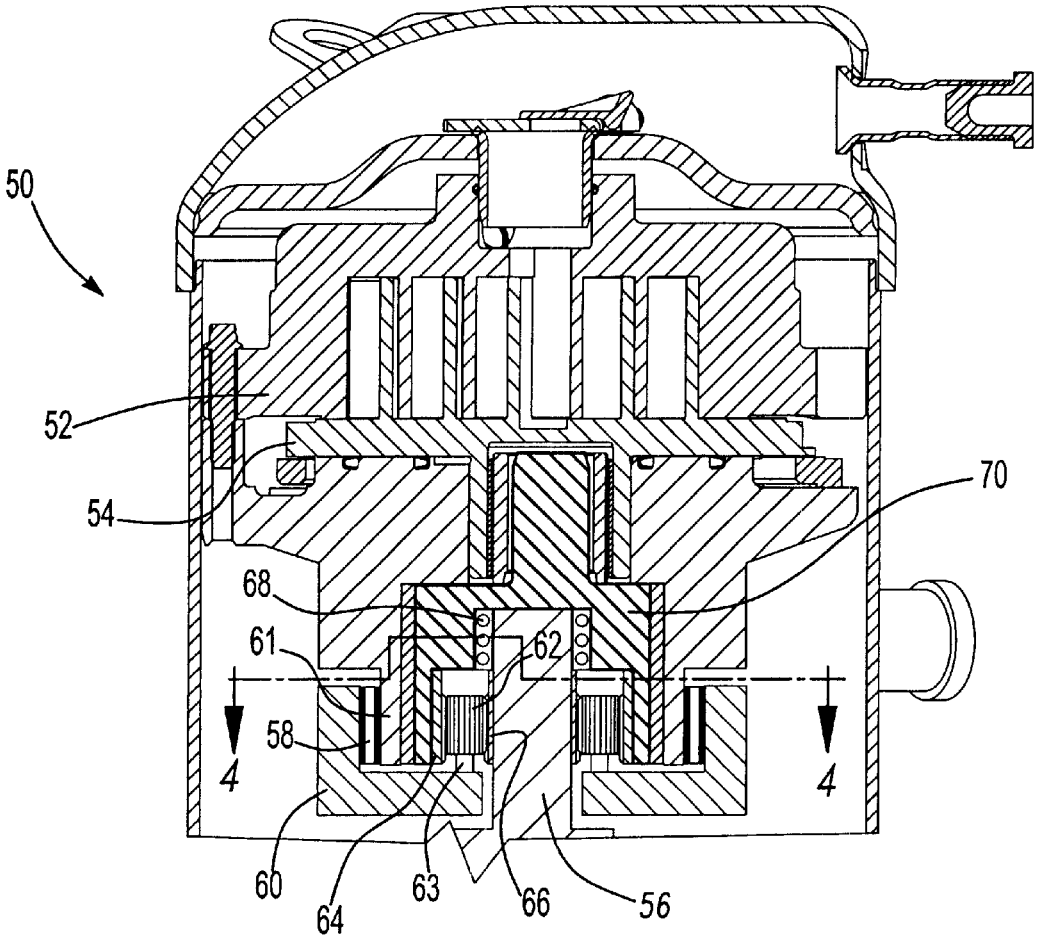
FIG. 3 is a second embodiment scroll compressor.

FIG. 3 shows a second embodiment 50. Second embodiment 50 includes a non-orbiting scroll 52, orbiting scroll 54 and a shaft top portion 56. A roller clutch 58 is provided between planet carrier 60 and a portion 61 of the crank case. Planet gears 62 rotate relative to the planet carrier 60.

A ring gear 64 is fixed to rotate with an eccentric 70 and surrounds the planet gears 62. A sun gear 66 is fixed to rotate with the shaft portion 56. A roller clutch 68 is positioned between the shaft portion 56 and the inside of an eccentric 70.

When the shaft 56 is driven in a forward direction, the roller clutch 68 transmits rotation directly to the eccentric 70. The orbiting scroll 54 is driven at the same rate as the shaft portion 56. The clutch 58 slips, and allows carrier 60 to free wheel on the position 61.

However, when reverse rotation occurs, then the roller clutch 58 no longer permits free-wheeling rotation. Shaft 56 and sun gear 66 drive the planet gears 62, however, the planet gears 62 can only rotate about the mounts 63 on the carrier 60, since the carrier 60 is locked to the portion 61 by the roller clutch 58. Thus, the eccentric 70 will be driven to rotate with its fixed ring gear 64. Again, the gear reduction is achieved and capacity modulation occurs.

Figure 4:
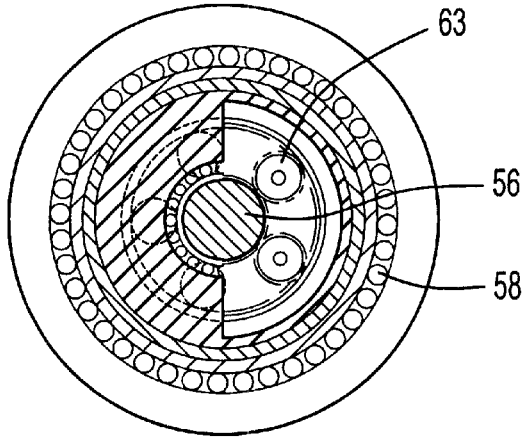
FIG. 4 is a cross-sectional view along line 4—4 as shown in FIG. 3.

A control as set forth with the first embodiment would be included to choose between forward and reverse drive. As shown in FIG. 4, there are a plurality of planet gears 62 and the system is operable as set forth above.

Figure 5:
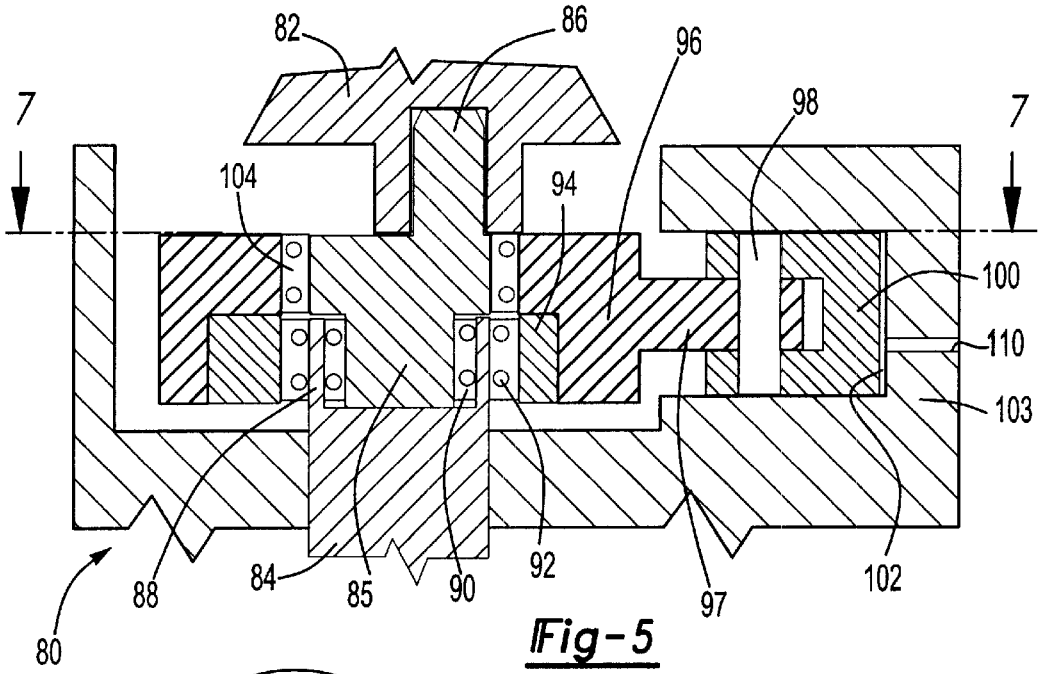
FIG. 5 is a third embodiment scroll compressor.

FIG. 5 shows another embodiment 80. In embodiment 80, a gear speed reduction is not utilized to achieve capacity modulation. Instead, an upper shaft portion 84 is positioned beneath an eccentric member 85 having a crank pin 86. A cylindrical portion 88 of upper shaft portion 84 is positioned radially outwardly of a first roller clutch 90. A second roller clutch 92 is positioned outwardly of cylindrical portion 88. An eccentric member 94 is positioned radially outwardly of clutch 92. A crank 96 surrounds eccentric 94. A finger 97 of crank 96 receives a crank pin 98, to pivotally attach it to a slide 100. Slide 100 is received within a guide 102 in the crankcase 103. Crank 96 drives the eccentric member 85 through another roller clutch 104. When shaft 84 is driven in a forward direction, roller clutch 90 transmits rotation from the upper shaft portion directly to the eccentric 85, and orbiting scroll 82 moves at the same rate as the motor.

However, when rotation occurs in a reverse direction, the roller clutch 90 allows slipping between the shaft portion 84 and the eccentric 85.

When rotation occurs in the forward direction, roller clutch 92 allows slippage between the portion 88 and the eccentric 94. However, when reverse rotation occurs, the eccentric 94 is driven. When the eccentric 94 is driven, the crank 96 is driven.

Also as shown in FIG. 5, by adding a port 110 (and perhaps other appropriate fluid structure such as an oil pickup take, etc.) forwardly the area in front of slide 100 can function as a pump, for oil, gas, etc.

Figure 6:
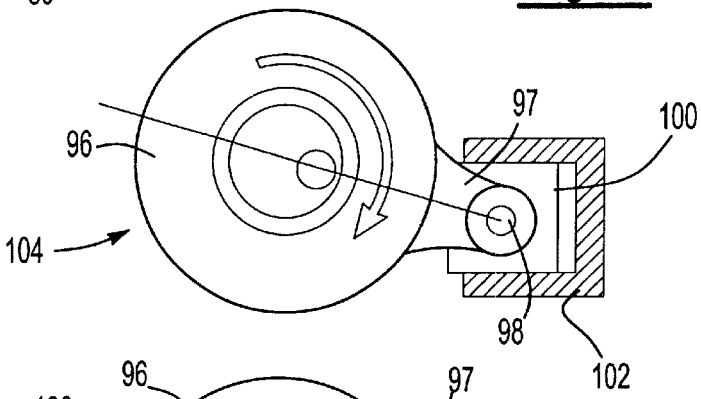
FIG. 6 shows one stage of operation of a portion of the FIG. 5 embodiment.
Figure 7:
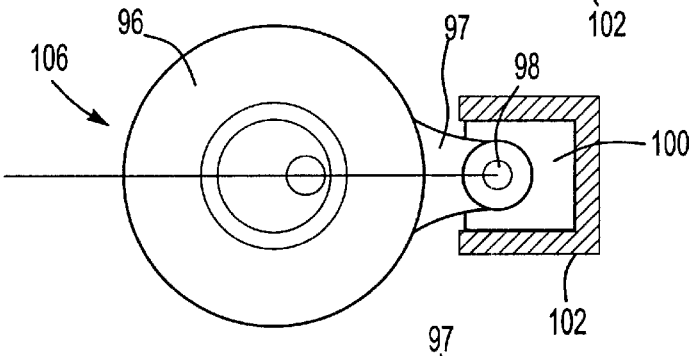
FIG. 7 shows another stage of operation of the FIG. 5 embodiment.
Figure 8:
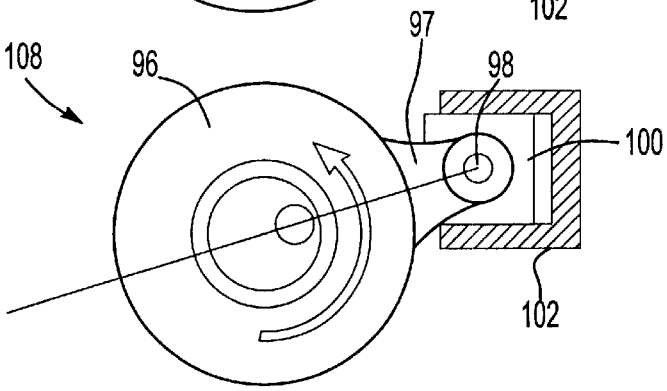
FIG. 8 shows a third stage of operation of the FIG. 5 embodiment.

As can be understood from FIGS. 6–7, as the eccentric 96 is driven, the finger 97 will move upwardly and downwardly as shown in FIGS. 6–8 as the slide 100 moves within its guide 102. Thus, in moving from the FIG. 6 to the FIG. 7 position, there will be rotation in a clockwise direction. However, once having reached the FIG. 7 position, the finger 97 and the slide 100 move in a counter clockwise direction. When being driven in one of these two directions, the movement of the crank 96 will drive the eccentric 86 through the roller clutch 104. When driven in the other, the crank 96 will slip relative to the eccentric portion 85. Thus, it is only during approximately 50% of the drive of the motor in the reverse direction that the eccentric 85 will be driven. This reduces the capacity of the compressor. Although it may seem that the intermittent movement and cyclic lack of movement would not result in efficient compression, in fact, the motors are rotating at such high revolutions per minute, that the effect is negligible.

Again, an appropriate control is incorporated to drive the motor in related directions to achieve capacity modulation.

Although suitable reversible electric motors are well known, one preferable motor would use windings such as disclosed in U.S. Ser. No. 08/911,481.

Although embodiments of this invention have been disclosed, it should be understood that the main inventive features of this invention is a provision of the motor which can be operated in reverse with a transmission that will cause the orbiting scroll to be rotated in the forward direction, but at a speed which differs from the speed of movement of the orbiting scroll during forward rotation. Many other embodiments may be developed which come within the scope of this invention.

A worker of ordinary skill in the art would recognize that modifications of these embodiments would come within the scope of this invention. For that reason, the following claims should be studied to determine the true scope and content of this invention.

What is claimed is:

1. A scroll compressor comprising:

a first scroll;

a second scroll being driven for orbital movement relative to said first scroll, said first and second scrolls defining compression chambers having a capacity;

a reversible electric motor to modulate the capacity of the compression chambers, said motor being operable to be driven in one direction at a first speed of rotation and cause said orbiting scroll to cyclically orbit in a forward direction at a first rate which is approximately equal to said first speed, and said motor being operable to be rotated in a reverse direction at said first speed, said orbiting scroll being caused to move in said forward direction when said motor is driven in said reverse direction at a rate which is different from said first rate by a mechanical transmission, wherein the compression chambers have a first capacity when the motor is driven in the forward direction and have a second capacity different from the first capacity when the motor is driven in the reverse direction.

2. A scroll compressor as recited in claim 1, wherein said different rate is lower than said first rate.

3. A scroll compressor as recited in claim 1, wherein said mechanical transmission includes a gear transmission which varies the speed of said motor to said orbiting scroll.

4. A scroll compressor as recited in claim 3, wherein said gear transmission provides a gear reduction.

5. A scroll compressor as recited in claim 4, wherein said gear transmission is a planetary gear transmission.

6. A scroll compressor as recited in claim 5, wherein roller clutches selectively transmit rotation from a motor shaft to said orbiting scroll when said shaft is driven in said one and said opposed directions.

7. A scroll compressor as recited in claim 3, wherein said gear transmission is provided between a shaft portion and an eccentric mounted between said shaft and said orbiting scroll.

8. A scroll compressor as recited in claim 1, wherein a one-way clutch connects said rotary motor to said second scroll when said motor is driven in said forward direction, such that said transmission does not affect the speed of movement of said second scroll when said motor is driven in said forward direction, and said one-way clutch allowing relative rotation between said motor and said second scroll member when said motor is driven in said reverse direction such that the drive of said second scroll by said rotary motor passes through said transmission when said motor is driven in said reverse direction.

9. A scroll compressor as recited in claim 1, wherein the first capacity is greater than the second capacity.

10. A scroll compressor comprising:

a first scroll member having a base and a scroll wrap extending from said base;

a second scroll member having a base and a scroll wrap interfitting with said first scroll wrap to define compression chambers having a capacity;

a bi-directional rotary motor for driving said second scroll relative to said first scroll to modulate the capacity of the compression chambers, said motor being driven in a forward direction and in a reverse direction, said motor being driven at a first speed in said forward and reverse directions; and a mechanical transmission for driving said second scroll in said forward direction when said motor is driven in both said reverse and forward directions, and at a speed which approximates the speed of said motor when said motor is driven in said forward direction, and said transmission reducing the speed of movement of said second scroll when said motor is driven in said reverse direction, wherein the compression chambers have a first capacity when the motor is driven in the forward direction and have a second capacity different from the first capacity when the motor is driven in the reverse direction.

11. A scroll compressor as recited in claim 10, wherein said transmission includes a planetary gear transmission.

12. A scroll compressor as recited in claim 11, wherein said planetary gear transmission is mounted between a shaft and an eccentric portion.

13. A scroll compressor as recited in claim 10, wherein a one-way clutch connects said rotary motor to said second scroll when said motor is driven in said forward direction, such that said transmission does not affect the speed of movement of said second scroll when said motor is driven in said forward direction, and said one-way clutch allowing relative rotation between said motor and said second scroll member when said motor is driven in said reverse direction such that the drive of said second scroll by said rotary motor passes through said transmission when said motor is driven in said reverse direction.

14. A scroll compressor as recited in claim 10, wherein the first capacity is greater than the second capacity.

15. A scroll compressor comprising:

a first scroll member having a base and a scroll wrap extending from said base;

a second scroll member having a base and a scroll wrap interfitting with said first scroll wrap to define compression chambers;

a shaft operably connected to drive said second scroll member to orbit relative to said first scroll member;

a bi-directional rotary motor for driving said shaft to in turn drive said second scroll relative to said first scroll, said motor being driven in a forward direction and in a reverse direction; and a one-way clutch for connecting said motor and shaft to drive said second scroll when said motor is driven in one of said forward and reverse directions, and a mechanical transmission for affecting the speed of movement of said second scroll when said motor is driven in a second of said forward and reverse directions, said one-way clutch allowing said motor and shaft to drive said second scroll when driven in one of said forward and reverse directions without passing through said transmission, and said one-way clutch allowing relative movement between said second scroll and at least one of said rotary motor and said shaft when said motor is driven in said second of said forward and reverse directions, wherein the compression chambers have a first capacity when the motor is driven in the forward direction and have a second capacity different from the first capacity when the motor is driven in the reverse direction.

16. A scroll compressor as recited in claim 15, wherein the first capacity is greater than the second capacity.

17. A scroll compressor as recited in claim 15, wherein said one of said forward and reverse directions is a forward direction.

18. A scroll compressor as recited in claim 15, wherein said transmission includes a planetary gear transmission.

* * * * *